United States Patent [19]

Stone et al.

[11] Patent Number: 4,980,696

[45] Date of Patent: Dec. 25, 1990

[54] RADOME FOR ENCLOSING A MICROWAVE ANTENNA

[75] Inventors: David S. Stone, Marion; Mark A. Carlson, Hanover, both of Mass.

[73] Assignee: Sippican Ocean Systems, Inc., Marion, Mass.

[21] Appl. No.: 341,907

[22] Filed: Apr. 24, 1989

Related U.S. Application Data

[63] Continuation of Ser. No. 48,713, May 12, 1987, abandoned.

[51] Int. Cl.[5] ..... H01Q 1/42

[52] U.S. Cl. ..... 343/872; 343/907

[58] Field of Search ..... 343/872, 705, 708, 907, 343/911 R

[56] References Cited

U.S. PATENT DOCUMENTS 4,179,699 12/1979 Lunden ..... 343/872

FOREIGN PATENT DOCUMENTS 815575 7/1959 United Kingdom ..... 343/872

1043125 9/1966 United Kingdom ..... 343/872

OTHER PUBLICATIONS

Morita et al., "Microwave Lens Matching by Simulated Quarter-Wave Transformers", Trans, IRE, vol. AP-3 (1955).

Jones et al., "Surface Matching of Dielectric Lenses", Jour. Appl. Physics, vol. 26, No. 4, pp. 452–457 (1955).

Handbook of Plastics and Elastomers, pp. 1–61 and 1–76 (1975).

*Primary Examiner*—Michael C. Wimer

*Attorney, Agent, or Firm*—Fish & Richardson

[57] ABSTRACT

A radome for enclosing a microwave antenna, including a structurally rigid and electrically thin enclosure wall having a foam shell and foam ridges projecting inwardly from the foam shell, so that the foam ridges and the void regions between them form a ridged wall layer.

13 Claims, 1 Drawing Sheet

RADOME FOR ENCLOSING A MICROWAVE ANTENNA

This is a continuation of application Ser. No. 07/048,713 filed May 12, 1987, abandoned.

Background of the Invention

This invention relates to radomes for enclosing microwave antennas.

Radome design must address structural requirements, including aerodynamic shape, rigidity, and resistance to weather, shock, impact, vibration, and biodegradation; as well as electrical characteristics, including minimal reflection of the passing microwave signal. Structural requirements for radomes are commonly met by using conventional glass fiber sandwich construction for the enclosure wall, but such radome walls tend to be highly reflective.

One approach to minimizing reflection in a radome wall is to choose the wall thickness with respect to the dielectric constant of the wall material and to the wavelength of the signal so that waves reflected from a front surface and from a back surface of the wall are cancelled by destructive interference. Another approach is to interpose on the surface a quarter-wavelength thick layer having a refractive index intermediate that of air and that of the main radome wall. Morita et al., "Microwave Lens Matching by Simulated Quarter-Wave Transformers", I. R. E. Transactions on Antennas and Propagation (1955), describe simulating such a quarter-wave matching section to reduce microwave reflections from the surface of a dielectric lens by corrugating the surface of the lens. In Lunden, U.S. Pat. No. 4,179,699, the inner surface of a foamed plastic radome wall has parallel ribs separated by void areas, forming quarter-wave surface openings to minimize reflection. A radome whose wall is designed by adopting either of these approaches functions optimally only for a microwave signal at the matched wavelength.

SUMMARY OF THE INVENTION

In general, the invention features a radome for enclosing a microwave antenna that has an electrically thin and structurally rigid enclosure wall having a foam shell having an outer surface and having foam ridges projecting inwardly from the foam shell, so that the foam ridges and the void regions between them form a ridged wall layer.

In preferred embodiments, the dimensions of the ridges are selected so that the enclosure wall is sufficiently rigid to have a total resonant drumming frequency greater than 1500 Hz; the enclosure wall has a reflection coefficient less than 10.0% (more preferably less than 1.0%, and ideally less than 0.1%); the thickness of the ridged wall layer is greater than the thickness of the foam shell; the dimensions of the ridges are selected so that the reflection coefficient of the ridge wall layer is less than 10% (more preferably less than 1.0%, and ideally less than 0.1%); the thickness of the foam shell is selected so that the reflection coefficient of the foam shell is less than 10% (more preferably less than 1.0%, and ideally less than 0.1%); the skin is a sheet (e.g., of Mylar ®) adhesively bonded to the foam shell; the foam shell is made of a cellular polymer; the foam ridges are made of a cellular polymer; the cellular polymer is polyurethane foam; there is a coating over the exterior surface of the skin and the coating is of urethane paint; the surface of the enclosure wall has the shape of a portion of a cylinder; the ridges are substantially straight and are oriented substantially parallel to the axis of the cylinder; the E plane of polarization of a microwave signal generated by the antenna is substantially parallel to the orientation of the ridges; and the enclosure wall is sufficiently rigid to have a resonant drumming frequency greater than 1500 Hz.

The radome of the invention meets the structural requirements for airborne applications, and is lightweight, inexpensive, and easy to manufacture. The enclosure wall has improved electrical characteristics for microwave signals over a broad range of wavelengths, and is particularly well-suited for broad bandwith applications.

Other features and advantages will be apparent from the following description of the preferred embodiment and from the claims.

Description of the Preferred Embodiment

Figure 1:
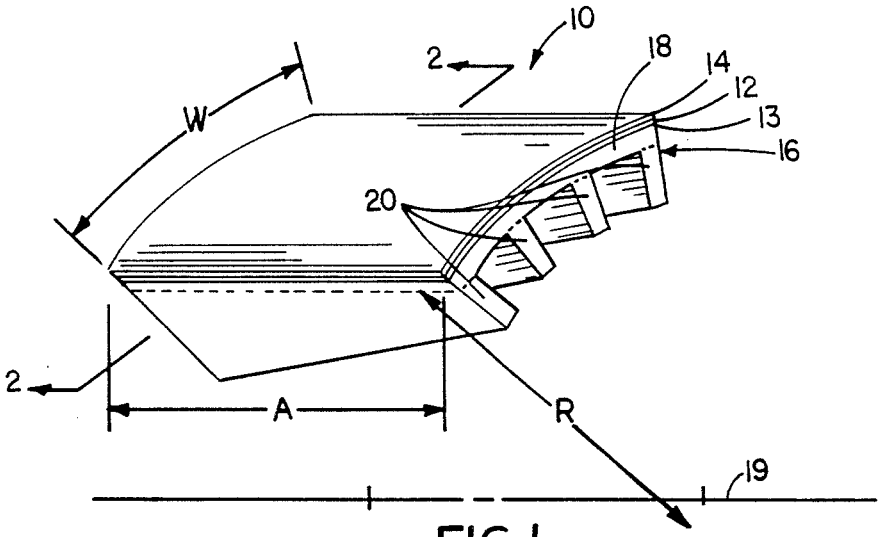
FIG. 1 is a perspective view of a portion of the preferred embodiment.

Referring to FIG. 1, an enclosure wall of a radome, a portion 10 of which is shown, includes a foam body 16 made up of a foam shell 18 and inwardly projecting foam reinforcing ridges 20. Overlying and adhesively bonded to the outward surface of foam shell 18 is a smooth skin 12. The exterior surface of skin 12 is coated with a coating 14 of paint. Foam shell 18 is made dimensionally thin to reduce the weight and the electrical thickness of the wall, and sufficiently dimensionally thick to provide shape and support for overlying skin 12. Foam ridges 20 provide reinforcement for the wall. Skin 12 provides an electrically thin, aerodynamically smooth surface. Coating 14 sheds water, reducing degradation of the passing signal by atmospheric water which might otherwise adhere to the exterior of the radome.

Foam body 16 is formed of a cellular or solid lightweight low loss material providing sufficent rigidity to meet the structural requirements of the particular radome application, preferably of a cellular or foam polymer and most preferably of polyurethane foam. Shell 18 is preferably of uniform dimensional thickness. Ridges 20 may be substantially linear, parallel and uniformly spaced as in FIG. 1; but the ridges and void regions may instead have other shapes, and they need not have uniform shape or thickness, provided they meet structural and electrical requirements. As examples, the ridges may have a sinuous shape when viewed from within the radome, or they may have a "waffle" or "honey comb" form. The foam body may be shaped by any convenient method, such as, for example, by molding or by cutting, or by a combination of methods; void spaces between ridges, for example, may be formed by cutting away or drilling out foam material from a foam block. The shell and ridges preferably form an integral unit, although the foam body may be made in portions. The skin is a smooth, non-porous layer of uniform structural thinness, preferably of a low loss electrically thin sheet such as Mylar ®, but suitable alternative materials may be used, such as, for example, Teflon ® or a glass laminate.

The skin is bonded to the foam body by means of any convenient adhesive, such as, for example, styrene butadiene rubber. The adhesive preferably is itself low loss and electrically thin, and to further minimize any signal-degrading effect it may have, the adhesive need not be applied as a continuous layer between skin and foam body, but may instead be applied as a discontinuous pattern of, for example, lines or dots.

Alternatively, instead of forming the skin by applying a sheet material onto the foam body, a skin may be formed on the outer suface itself of the foam body by chemically or physically treating the surface to render it smooth, non-porous, and resistant to weather and biodegradation.

Figure 2:
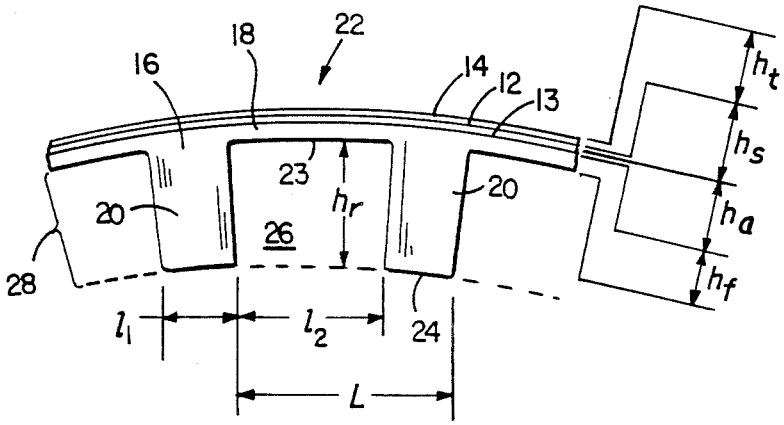
FIG. 2 is a cross-sectional view along 2—2 in FIG. 1.

The important dimensions of the various elements of the radome enclosure wall are shown in FIG. 2: $h_c$ is the thickness of the coating 14 on the exterior surface of the skin 12; $h_s$ is the thickness of the skin 12; $h_a$ is the thickness of the adhesive layer 13; $h_f$ is the thickness of the foam shell 18; $h_r$ is the height of the foam ridges 20 as measured from the inner limit 23 of the foam shell 18 to the inner limit 24 of the ridges 20; $l_1$ is the average width across the ridges 20, $l_2$ is the average width across the void regions 26 between the ridges 20; and L is the average period of the ridges. Ther term "average width" is used, because the widths of the ridges and the voids need not be uniform over the height $h_f$ of the ridges; an average width may be calculated as, for example, the root mean square width averaged over the overall height $h_r$.

As described in, e.g., M. Born and E. Wolf, *Principles of Optics*(6th Ed. 1980), generally the reflection coefficient, R, for a wall layer, i.e , the proportion of microwave signal power incident upon the wall layer that is reflected by that wall layer is expressed by the relation:

$$R = \frac{P_r}{P_o} = \frac{16\pi^2 h^2}{\lambda^2}(\epsilon)\left(\frac{\sqrt{\epsilon}-1}{\sqrt{\epsilon}+1}\right)^2 \quad (1)$$

where $P_r$ is the power reflected from the layer, $P_o$ is the power incident on the layer, h is the thickness of the layer, $\lambda$ is the wavelength of the signal, and $\epsilon$ is the dielectric constant of the material in the layer. A radome enclosure wall layer may be made optimally "electrically thin" by minimizing the reflection of signal from the wall layer. Reflection of signal from a radome enclosure wall layer is minimized by making the reflection coefficient much less than 1, that is at a reflection figure of merit ("RFOM") given by:

$$RFOM = \frac{16\pi^2 h^2}{\lambda^2}(\epsilon)\left(\frac{\sqrt{\epsilon}-1}{\sqrt{\epsilon}+1}\right)^2 << 1 \quad (2)$$

is satisfied where:

$$h << \frac{\lambda}{4\pi}\left(\frac{1}{\sqrt{\epsilon}}\right)\left(\frac{\sqrt{\epsilon}+1}{\sqrt{\epsilon}-1}\right) \quad (3)$$

Thus, a wall layer such as the radome skin or frame shell may be made electrically thin with respect to a given wavelength or a given range of wavelengths by choosing its thickness dimension h so that equation 3 is satisfied for the dielectric constant of the wall layer material and across the specified bandwidth.

The ridges 20 and the void regions 26 among the ridges together constitute a "ridged wall layer" 28 inward of the foam shell, which may similarly be made electrically thin. The ridged wall layer 28 has a thickness $h_f$ and an effective dielectric constant $\epsilon_{eff}$. Owing to the void spaces, the effective dielectric constant $\epsilon_{eff}$ of the ridged wall layer 28 is less than the dielectric constant $\epsilon$ of the foam itself, and, as disclosed by T. Morita and S. B. Cohn. "Microwave Lens Matching by Simulated Quarter Wave Transformers", IRE Transactions on Antennas & Propagation, Vol. AP.4 (1956), is expressed by the relation:

$$\epsilon_{eff} = \epsilon\left(\frac{l_1 + l_2}{l_1 + \epsilon l_2}\right) \quad (4)$$

for the case in which the E plane of the signal is parallel to the ridges. Thus, by substitution of $\epsilon_{eff}$ from equation (4) for $\epsilon$ in equation (3), the RFOM is realized for the ridged wall layer 28 where $h_r$, $l_1$, and $l_2$ are chosen so that:

$$h_r << \frac{\lambda}{4\pi}\left(\frac{1}{\sqrt{\epsilon_{eff}}}\right)\left(\frac{\sqrt{\epsilon_{eff}}+1}{\sqrt{\epsilon_{eff}}-1}\right) \quad (5)$$

It has been discovered that this requirement can be satisfied over a broad bandwidth: by appropriate choice of $l_1$, $l_2$, and $h_r$ sufficient to provide the requisite structural reinforcement for the foam shell.

For a radome wall made up of several "thin" layers, the total reflection coefficient of a microwave signal normally incident on the wall is, at worst, the sum of the reflection coefficients of all the layers. In practice the total reflection coefficient is less than this, owing to favorable effects such as destructive interference between the layers. The total reflection coefficient is preferably 10%, more preferably 1%, and most preferably 0.1%.

A range of shapes, arrangements, and relative widths of ridges and void regions in the ridged wall layer will satisfy the electrical requirements for a radome enclosure wall. In order for the ridges and voids to be "seen" by an incident wave as a layer of material having an effective dielectric constant $\epsilon_{eff}$, rather than as a discontinuous layer having dielectric constant $\epsilon$, the voids and ridges must be sufficiently narrow so that they escape resolution at all wavelengths within the specified bandwidth. This will pertain if the average period L of ridges in the plane normal to the incident signal path ($L = l_1 + l_2$) satisfies the following relation:

$$\frac{\lambda}{\sqrt{\epsilon}} \quad (6)$$

L is less than or approximately equals $$\frac{\lambda}{\sqrt{\epsilon}} \quad (6)$$

where $\lambda$ is any wavelength within the bandwidth of the incident signal, and $\epsilon$ is the dielectric constant of the foam material.

The requirements for rigidity of a radome enclosure wall will to some extent be determined by the specified overall shape and size of the radome and the size and shape of antenna to be enclosed within the radome.

The dimensions of the various elements of the wall, and particularly of the foam body, are chosen to meet the constraints imposed by the electrical requirements, as described above, as well as to satisfy the requirements for rigidity, according to methods well-known in the art.

For example, and by way of illustration, an approach is outlined below for maximizing the mechanical stiffness of a radome to prevent excessive vibration amplitudes when the radome is subjected to mechanical vibration, where, with reference again to FIG. 1, the radome wall takes the form of a portion of the surface of a cylinder of length A and radius R, having an arcuate width W. The resonant drumming frequency of such a radome wall is maximized as follows.

For the foam shell 18, the resonant drumming frequency $f_s$, in Hertz, for mechanical vibration, as described by Morita et al., supra, is expressed by the relation:

$$f_s\,(\mathrm{Hz}) = \frac{1}{2\pi^2}\left(\frac{gA_oE}{R^2P}\right)^{\frac{1}{2}} \tag{7}$$

where $$A_o = \left(\frac{\pi}{A}\right)^4\left[\left(\frac{\pi}{A}\right)^2 + \left(\frac{\pi}{W}\right)^2\right]^{-2} \tag{8}$$

and where g=3.864 inches/sec.$^2$, E is the elastic modulus in pounds/inch$^2$, and P is the mass density of the foam material in pounds/inch$^3$.

For the ridged layer 28, the resonant drumming frequency $f_r$, in Hertz, is expressed by, as described by Morita et al., supra, the relation:

$$f_r\,(\mathrm{Hz}) = \left[(0.907)^2\left(\frac{gl_1h_rE}{A^4P}\right)\right]^{\frac{1}{2}} \tag{9}$$

And the total drumming frequency $f_{total}$ (from layers 18 and 28), in Hertz, for the radome is derived from coupled spring-constant theory as described by W. T. Thompson, *Theory of Vibration With Applications* (2nd ed. 1981) by the relation:

$$f_{total}\,(\mathrm{Hz}) = \left(\frac{\left[\frac{1}{(2\pi)^2}\frac{gA_o}{R^2}\sum_{\substack{\text{thin}\\\text{layers}}} Eh_r\right] + (0.907)^2\left(\frac{gl_1h_r}{A^4}\right)NEh_r}{\left[\sum_{\substack{\text{thin}\\\text{layers}}} Ph\right] + \left(\frac{W}{l_1+l_2}\right)NPh_r}\right) \tag{10}$$

The height $h_r$ of the ridges may be different at different points in the enclosure wall, so long as the dimensions satisfy the electrical and structural requirements. The inner limit 24 of the ridges may be varied, for example, where convenient, to define an inner space having the shape and dimensions of the payload, so that the payload is held in place at least in part by the ridges. Alternatively, foam braces may extend to the payload from the ridges to help hold the payload in place. But, for particular applications, the enclosure wall need not help hold the payload in place.

In a preferred embodiment in which the enclosure wall has such a cylindrical surface, the radius R is 2.95 inches, the width W is 5.9 inches, and the length A is 5.9 inches; the foam body is of polyurethane; the thickness of the shell $h_s$ is 0.1 inches; there are 6 ridges, all straight, oriented parallel to the cylindrical axis, and uniformly spaced apart, and the width $l_1$ of each ridge is 0.3 inches, the width $l_2$ of each void region between ridges is 0.7 inches, and the height $h_r$ of each ridge varies linearly over its length A typically between about 0.2 inch and 1.0 inch to conform to the shape of the enclosed antenna; the skin is a Mylar ® sheet having a thickness $h_s$ of 0.005 inches, and is bonded to the foam body with styrene butadiene rubber adhesive in a uniform layer about 0.002 inches thick, or less; and the exterior surface of the skin has a coating 0.00075 inches thick of urethane paint.

Other embodiments are within the following claims:

We claim:

1. A radome for enclosing a microwave antenna, comprising an enclosure wall comprising a foam shell having an outer surface and a thickness h/hd/f, and a plurality of foam ridges projecting inwardly from said foam shell, said foam ridges being separated by void regions, said foam ridges and said void regions forming a ridged wall layer having a wall layer thickness $h_r$, said ridged wall layer thickness $h_r$ being greater than said foam shell thickness $h_f$, the average width of said void regions being greater than the average width of said foam ridges, said enclosure wall having a reflection coefficient of less than 10% over a range of microwave wavelengths.

2. The radome of claim 1 wherein said reflection coefficient of said enclosure wall is less than 1% over said range.

3. The radome of claim 1 wherein said reflection coefficient of said enclosure wall is less than 0.1% over said range.

4. The radome of claim 1 further comprising a sheet adhesively bonded to said foam shell.

5. The radome of claim 4 wherein said sheet comprises polyester film.

6. The radome of claim 1 wherein said foam shell comprises a cellular polymer.

7. The radome of claim 6 wherein said cellular polymer is a polyurethane foam.

8. The radome of claim 1 further comprising a coating over said exterior surface of said foam shell.

9. The radome of claim 8 wherein said coating comprises urethane paint.

10. The radome of claim 1 wherein said enclosure wall is formed so that said outer surface has substantially the shape of a portion of the surface of a cylinder.

11. The radome of claim 10 wherein said ridges are substantially straight and have an orientation substantially parallel to the axis of said cylindrical surface.

12. The radome of claim 11 wherein the E-plane of polarization of a microwave signal generated by said antenna is substantially parallel to said orientation.

13. The radome of claim 1 wherein $h_r$, said average width of said ridges, and said average width of said void regions are selected so that said enclosure wall is sufficiently rigid to have a total resonant drumming frequency greater than 1500 Hz.

* * * * *

UNITED STATES PATENT AND TRADEMARK OFFICE

CERTIFICATE OF CORRECTION

PATENT NO. : 4,980,696

DATED : 12/25/90

INVENTOR(S) : David S. Stone and Mark A. Carlson

It is certified that error appears in the above-identified patent and that said Letters Patent is hereby corrected as shown below:

Col. 3, equation (1), "R" should be --$R_f$--.

Col. 4, delete equation (6). (lines 55-57).

Col. 5, equation (10), in the denominator, "Ph" should be --$Ph_r$--.

Col. 5, equation (10), in the denominator, "W" should be --$1_1$--.

Col. 5, after equation (10), insert --where N=the number of ridges.--

Col. 6, line 24, "h/hd/f" should be --$h_f$--.

Signed and Sealed this

Ninth Day of March, 1993

*Attest:*

STEPHEN G. KUNIN

*Attesting Officer*

*Acting Commissioner of Patents and Trademarks*